US007752679B2

(12) United States Patent
Romero et al.

(10) Patent No.: US 7,752,679 B2
(45) Date of Patent: Jul. 13, 2010

(54) PROTECTIVE GEAR

(75) Inventors: Gina Romero, Soquel, CA (US); Brendan Erik Pierce, San Jose, CA (US); Eric Michael Onno Bergman, San Francisco, CA (US); Chris Gagan, North Vancouver (CA)

(73) Assignee: Fox Racing, Inc., Morgan Hill, CA (US)

( * ) Notice: Subject to any disclaimer, the term of this patent is extended or adjusted under 35 U.S.C. 154(b) by 179 days.

(21) Appl. No.: 11/233,766

(22) Filed: Sep. 22, 2005

(65) Prior Publication Data

US 2006/0096000 A1 May 11, 2006

Related U.S. Application Data

(60) Provisional application No. 60/612,664, filed on Sep. 23, 2004.

(51) Int. Cl.
*A41D 13/00* (2006.01)

(52) U.S. Cl. ..... 2/24

(58) Field of Classification Search ..... 2/22, 2/16, 455, 24, 911; 128/878, 881, 882; 602/23, 602/26, 62

See application file for complete search history.

(56) References Cited

U.S. PATENT DOCUMENTS 4,847,818 A * 7/1989 Olsen ..... 368/10
5,297,294 A * 3/1994 Washick ..... 2/22
5,647,145 A 7/1997 Russell et al.
5,915,529 A 6/1999 Popowski
6,272,682 B1 * 8/2001 Fullum ..... 2/22
6,453,477 B1 9/2002 Bainbridge et al.
2004/0083527 A1 5/2004 Budda
2004/0103466 A1 6/2004 Gold et al.
2004/0154083 A1 8/2004 McVicker

OTHER PUBLICATIONS

Fox Racing Raptor Elbow Guard- Motorcycle USA Superstore; printed Sep. 17, 2004; www.motorcycle-superstore.com/item.aspx?style=11598&department=208&Division=2; 1 page.

Fox Racing Raptor Knee/Shin Guard- Motorcycle USA Superstore; printed Sep. 17, 2004; www.motorcycle-superstore.com/item.aspx?style=1598&department=208&Division=2; 2 page.

30 Years of Maximum Motocross—1974-2004—FOX—Product Catalog; Copyright 2003; Fox Racing, Inc. Morgan Hill, California; Cover sheet, pp. 67 and 77 (3 pages total).

* cited by examiner

*Primary Examiner*—Tejash Patel
(74) *Attorney, Agent, or Firm*—Ganz Law, P.C.

(57) ABSTRACT

Protective gear for a wearer's body such as the joint of a limb, that has an attachment system with few components, and integrated with the protective gear. The attachment system uses straps that can be adjusted by a wearer once during a first use and, after removal, retain their adjustments for a second use by the same wearer. Securing the attachment system in place can be accompanied by an auditory signal.

18 Claims, 18 Drawing Sheets

PROTECTIVE GEAR

CROSS-REFERENCE TO RELATED APPLICATIONS

This application claims priority to and the benefit of U.S. provisional patent application Ser. No. 60/612,664, filed on Sep. 23, 2004, by Gina Romero et al., entitled "PROTECTIVE GEAR," the entire disclosure of which is hereby incorporated by reference as if set forth in its entirety for all purposes.

BACKGROUND OF THE INVENTION

This invention relates to protective sports gear including, knee guards, shin guards, elbow guards, and other protective gear for body joints. Protective gear is commonly used in sports where a participant risks injury from accidental collisions with the ground, obstacles, or other participants. For example, U.S. Pat. No. 5,915,529 (herein incorporated by reference) describes protective joint guards used in in-line skating, and U.S. 2004/0083527 (herein incorporated by reference) describes protective gear for a leg or elbow useful for sports and other activities. Similar protective joint guards also are used in a variety of other sports, such as motorcycle racing, motocross, go-kart racing, snowmobiling, and other motor sports; skiing and snowboarding; skateboarding; street luge; mountain biking, BMX racing, and other bicycle competitive sports; hockey, baseball, and other sports where some participants (e.g., goalies and catchers) risk being hit by high-speed projectiles; and rock climbing, whitewater kayaking, mountain climbing, and other outdoor sports. Additionally, protective gear can be worn to guard against occupational or injuries, such as hazards faced by workers in the forestry, construction, mining, and manufacturing industries.

Typical protective gear may include flexible cushioned pads, abrasion-resistant and puncture-resistant shielding, and adjustable straps for attaching the protective gear to a person's body. Many types of protective gear use simple elastic straps and hook-and-loop attachments (e.g., Velcro®) for securing the gear to a body region. For example, U.S. Pat. No. 5,915,529 describes a knee or elbow guard that is worn by looping an elastic strap around an upper limb, looping a similar elastic strap around a lower limb, and securing both straps with a hook-and-loop closure. These elastic straps provide adequate adjustment, but the wearer must adjust the straps for fit during every use. Additionally, the straps may be jostled loose during the sporting activity. In sports where the wearer is highly physically active for long periods of time, such as motocross racing, the wearer often must readjust the straps for proper fit during the sporting event. Other pads use a different attachment method, which can provide more secure attachment, but also involves many more components. For example, the protective gear in U.S. 2004/0083527 can be attached using eight pairs of laces. This system of laces can keep the pad in place for a longer time during heavy use (compared to a system using just two elastic straps), but it involves many more components that take a much longer time for the wearer to secure and adjust. Additionally, the wearer must adjust the fit of the gear prior to each use.

Some protective gear includes a quick set-up attachment and release mechanism. This mechanism allows the wearer to adjust the fit of the gear once during a first use, and the gear retains the adjustments after removal. Thus, the wearer can quickly apply and remove the protective gear without the necessity of adjusting the fit every time. As just one example, this quick set-up attachment and release mechanism is used in the Raptor™ knee/shin guard (a prior system of the assignee). However, some quick set-up mechanisms include many small components that require manipulation and setting by the wearer.

SUMMARY OF THE INVENTION

Among other advantages, the present invention overcomes problems in the prior art by providing protective gear with a quick, one-time set-up attachment mechanism for attaching and wearing the protective gear. As used herein, the term "protective" is not intended to mean that the wearer is completely protected from all potential injuries. Instead, the term "protective" means that the gear provides some measure of deflection against outside forces imparted upon the wearer during use. For example, the protective gear can be used in motocross racing, which involves numerous risks of injury from hazards such as collisions with other racers, accidental collisions with retaining walls and other obstacles on the track, dirt and rocks kicked up by motorcycle tires, and accidental spills by motorcycle riders during the race. The protective gear described herein does not necessarily eliminate all risk of injury to a rider wearing the gear. Instead, the protective gear deflects at least part of the injurious force that a rider would otherwise suffer had the rider not been wearing the protective gear.

This protective gear has following features and elements, alone or in combination:

1. An abrasion-resistant and/or impact-resistant protective shield having a disengagable portion and a docking portion. The disengagable portion includes a first coupling element and the docking portion comprises a second complementary coupling element that couple together when the disengagable portion is engaged with and coupled to the docking portion. The shield can include other portions, however. In some embodiments, the disengagable portion and docking portion comprise a middle protective portion, and the shield includes an upper protective portion and a lower protective portion moveably connected to the middle shield portion. Such an arrangement can facilitate articulation of a protected body joint.

2. An attachment system for attaching the protective gear to the body of a wearer, which is operably connected to both the disengagable portion and the docking portion. The disengagable portion is coupled to the docking portion when the protective gear is attached to the wearer's body. Thus, the disengagable portion and docking portion can be considered part of the protective shield and part of the attachment system.

3. The protective guard, including the shield, is anatomically conformed to fit the shape of the body part being protected.

4. When the disengagable portion is coupled to the docking portion, the outer surfaces of each are substantially flush with each other. The coupling elements of the disengagable portion and docking portion are recessed beneath the outer surface of the shield and hidden from external view when the protective gear is worn on a body.

5. Coupling the disengagable portion to the docking portion emits a signal to the wearer, such as an auditory or tactile signal similar to a snapping or popping sound and corresponding sensation. This signal can indicate when the protective gear is fully attached to the wearer's body.

In some embodiments, the protective guard is anatomically conformed and adapted to fit the knee or elbow of a human body. For example, the shield can include two disengagable portions that attach to a middle shield portion and protect the lateral and medial sides of the knee or elbow joint. In such an embodiment, the shield can include a middle protective portion anatomically conformed to protect the patella and sides of the knee; an upper protective portion anatomically conformed to protect the upper part of the knee and lower thigh; and a lower protective portion anatomically conformed to protect the lower part of the knee and lower leg.

These and other embodiments are described in more detail in the following detailed descriptions and the figures. The foregoing is not intended to be an exhaustive list of embodiments and features of the present invention. Persons skilled in the art are capable of appreciating other embodiments and features from the following detailed description in conjunction with the drawings.

BRIEF DESCRIPTION OF THE DRAWINGS

FIG. 17 shows a frontal view of the upper part of the protective gear according to the present invention, similar to FIGS. 9, 11 and 14. The right clasp is shown proximate to the patella plate and in its position soon after removal from the patella late or just prior to attachment to the patella plate.

FIG. 18 shows a frontal view of the upper part of the protective gear according to the present invention. The clasps are shown apart and unattached from the patella plate.

DETAILED DESCRIPTION OF THE INVENTION

Figure 1:
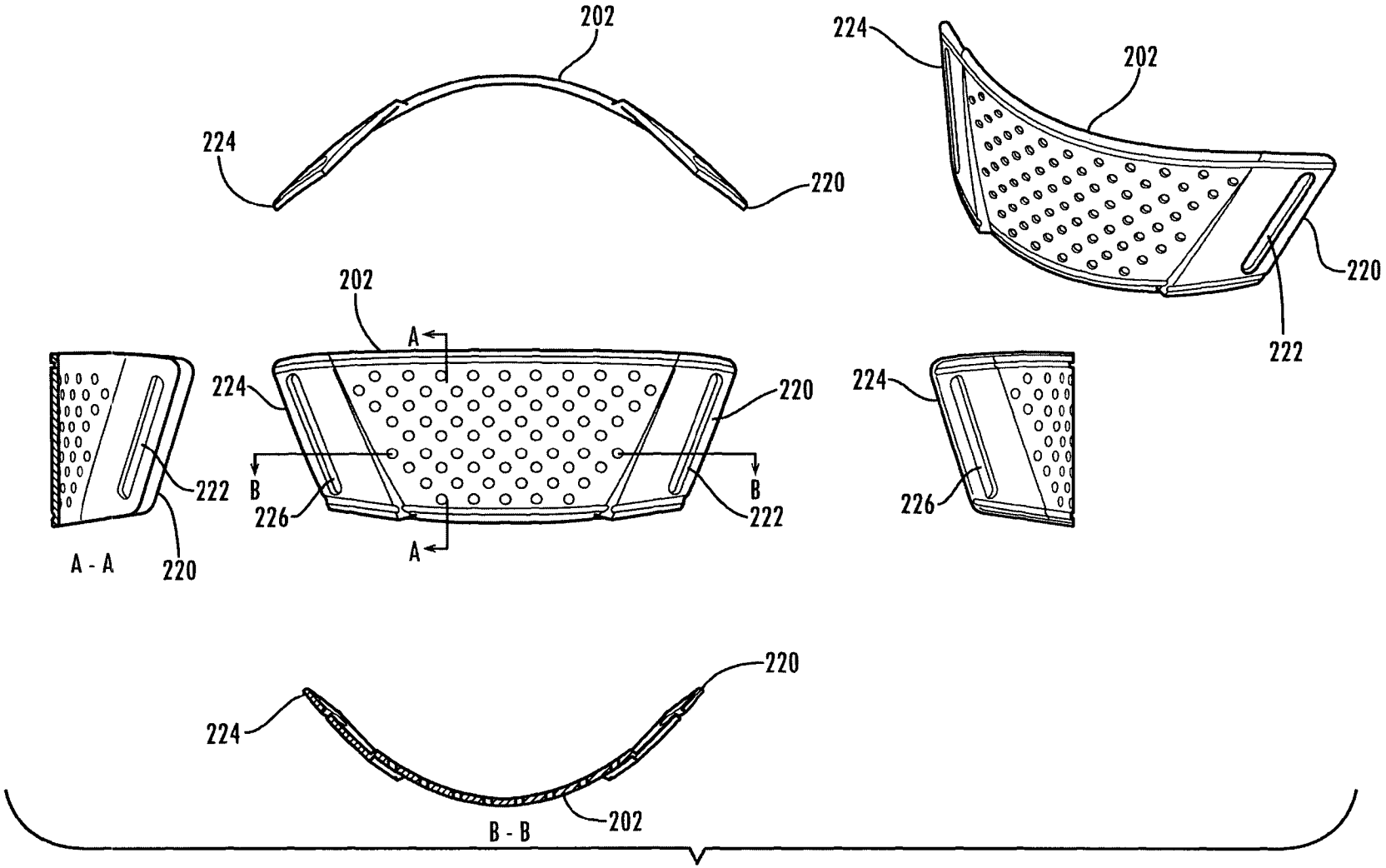
FIG. 1 shows several different views of a thigh plate for use in protective gear according to the present invention.

The present invention is protective gear for a wearer's body that includes an improved, integrated attachment system with many novel and useful features. The quick set-up attachment system can be adjusted once during a first use and retain its adjustment settings after it is removed from the wearer's body. The attachment system retains its settings after being removed from the wearer's body, and no repeated adjustment is required when the protective gear is attached to the same wearer's body a second time.

This attachment system also includes a coupling mechanism that is protected by the shield. Portions of the shield itself include integrated coupling elements, and the attachment system involves coupling these shield portions together. Thus, the attachment system is integrated with the shield and portions of the shield also function as parts of the attachment system.

Securing the attachment system in place can be accompanied by a signal, which provides some utility by signaling when the attachment system has been fully secured on the wearer. The signal can be any appropriate signal, such as a visual, auditory, or tactile signal, or a combination of appropriate signals. In some exemplary embodiments, the signal is a combined auditory and tactile signal that produces a snapping or popping sound and sensation when the shield portions have been fully coupled to one another.

In addition to the shield, the protective gear can include a flexible, cushioned pad. The shield can be mounted on this cushioned pad, and the attachment system can be operably coupled to the pad as well as the shield. Thus, the pad can be considered a backing member upon which the shield can be mounted.

The protective guard can be anatomically conformed to and adapted for any appropriate part of a human or animal body. An anatomically conformed protective guard is one in which the inner surface is fitted or molded to the body surface of the body part sought to be protected; or the inner surface includes compressible foam, gel, encapsulated beads, or other compressible material that compresses against and fits to the body surface of the body part sought to be protected; or the inner surface otherwise includes some feature allowing it to conform to the body surface of the body part sought to be protected. In some embodiments, an anatomically conformed protective guard also includes an outer surface shaped to substantially conform to the external dimensions of the body part sought to be protected. As just one, non-limiting example, the illustrated embodiment described below is a knee guard having an outer protective shield with a substantially rounded or semi-spherical portion that generally conforms to the rounded shape of a knee.

In some embodiments, the protective guard is anatomically conformed to the shape of a human joint, such as a knee, elbow, wrist, ankle, shoulder or hip. In particular embodiments, the protective guard is adapted for a human knee or elbow. However, the protective guard can be adapted for other parts of the human body or to be worn by non-human animals, too. For example, the protective guard can be adapted to protect the chest, torso, and/or back of a human wearer. As another example, the protective guard can be adapted for use as a knee or leg guard for horses that race steeple chase.

The protective guard can be sized to fit an intended wearer, either during custom fitting or mass production. The size of any particular embodiment can depend on a number of factors, such as the overall height, weight, limb length, and other physiological characteristics of the wearer; and the relative size of the body part or joint sought to be protected.

Any suitable materials can be used to produce the protective guard. The shield can be made from any suitable material that resists abrasion, impact, puncturing, shattering, torsion, and similar forces anticipated during use. Exemplary (non-limiting) materials include plastic or other polymer; metal, such as tungsten, stainless steel, or other alloy; Kevlar, ballistic nylon, or other similar fabric; or carbon fiber. The shield can be composed of a single material or a combination of materials, such as a laminate, and can be of a unibody construction or composed of several shield portions or plates operably connected together.

The cushioned pad can be made of any suitable flexible, impact-absorbing cushioning materials and fabrics, such as those described in U.S. Pat. No. 6,453,477 (herein incorporated by reference). Similar to the shield, the cushioned pad can be a unibody construction or composed of independent pieces or divided parts operably coupled together.

Figure 8:
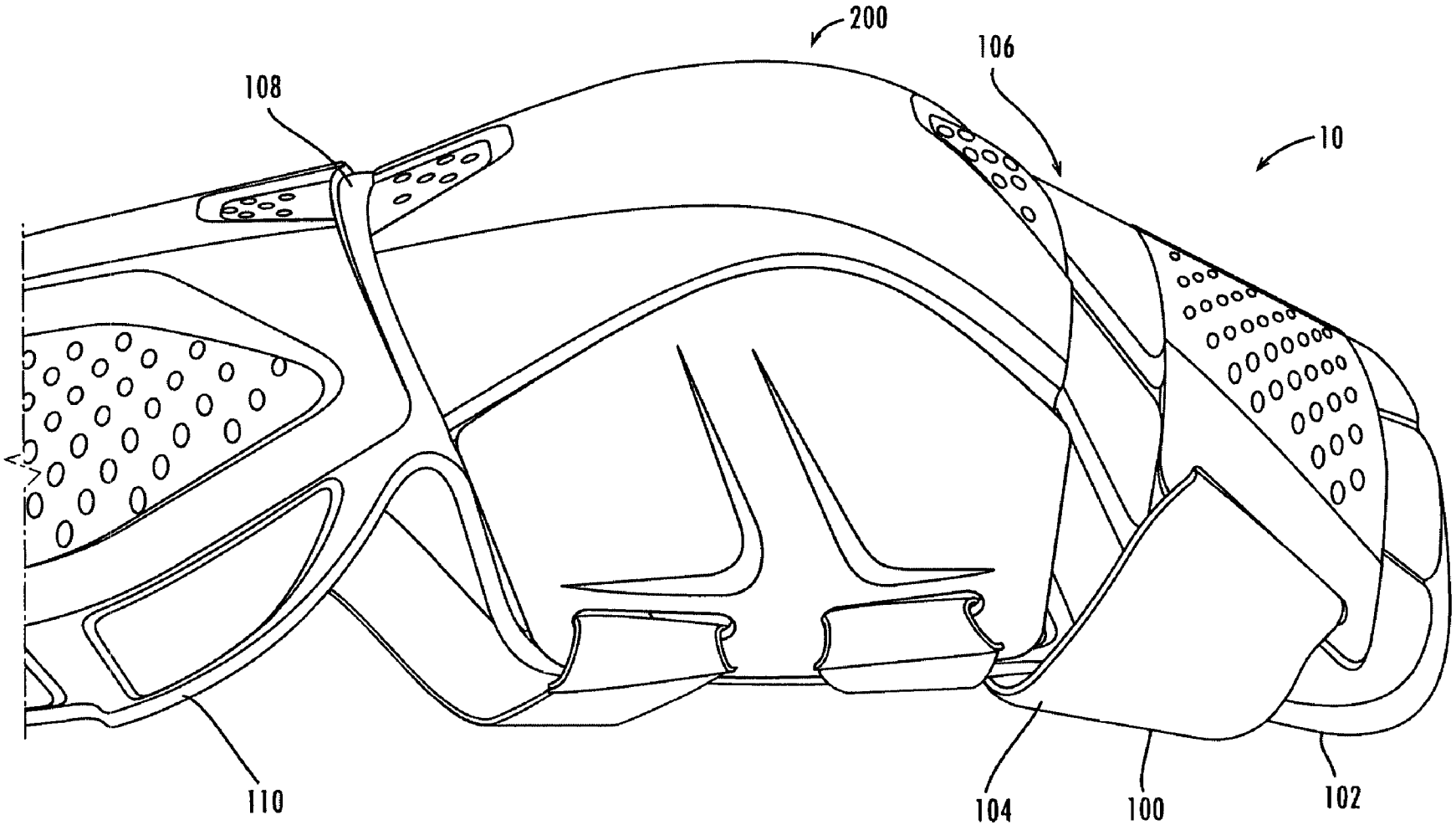
FIG. 8 shows a side view of the upper part of the protective gear according to the present invention; the clasps are shown attached to the patella plate.
Figure 9:
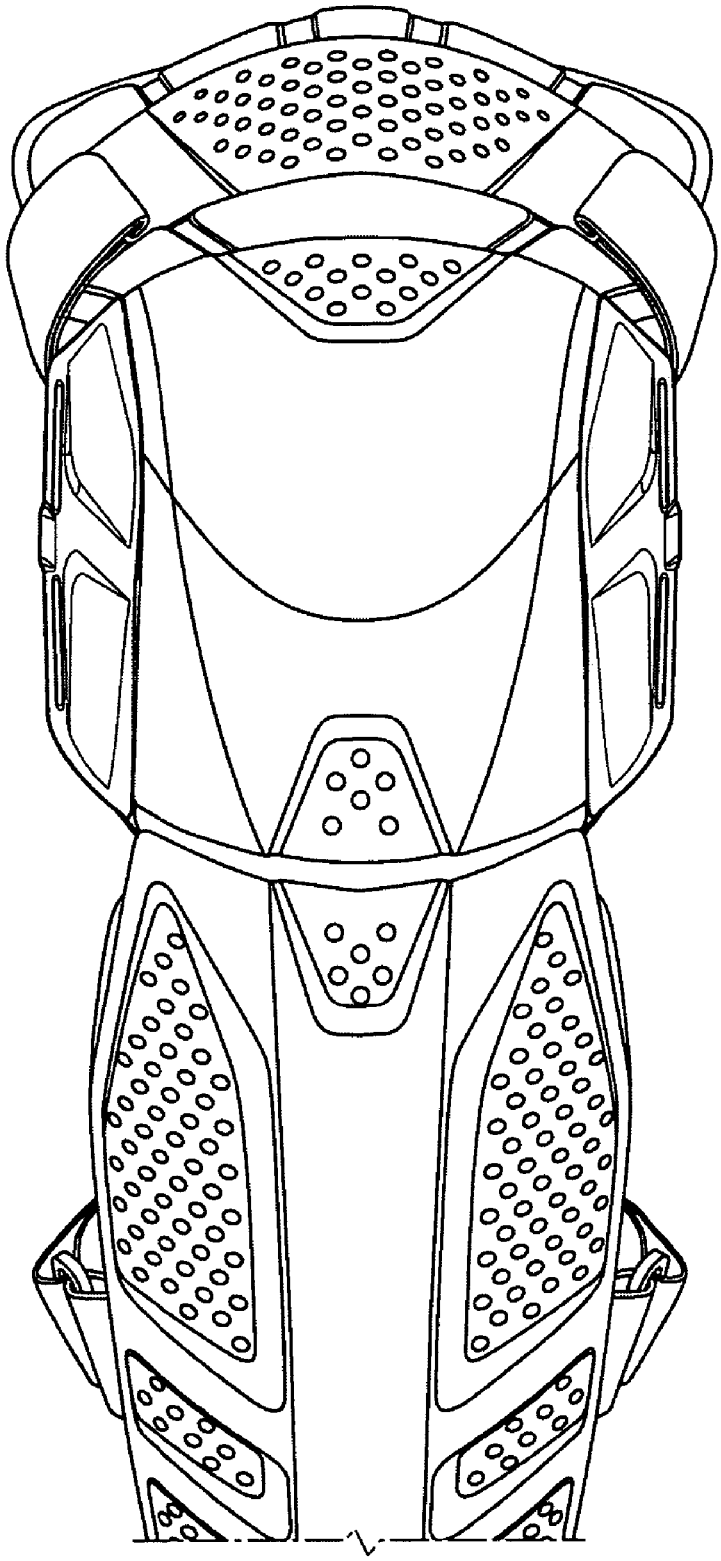
FIG. 9 shows a frontal view of the upper part of the protective gear according to the present invention; the clasps are shown attached to the patella plate.

A protective guard 10 according to the present invention is shown in the figures. In this illustrated embodiment, the protective guard 10 is a knee guard. Referring to FIG. 8, the illustrated knee guard 10 includes a flexible cushioned pad 100 having an outer surface 102 and an inner surface 104, which lies closer to the wearer's body than the outer surface. In the illustrated knee guard 10, cushioned pad 100 is composed of upper pad portion 106 that covers a front part of the wearer's lower thigh, middle pad portion 108 that covers a front part of the wearer's knee, and lower pad portion 110 that covers a front part of the wearer's lower leg. In this embodiment, cushioned pad 100 is a single, contiguous pad having pockets of cushioning material (which can be seen in FIG. 10). The cushioning material is relatively thinner in places where the pad is intended to bend when the wearer articulates the protected knee joint.

Joint guard 10 optionally includes an abrasion-resistant and impact-resistant shield 200, illustrated in FIGS. 1-7. The illustrated embodiment of shield 200 has six plates: an upper plate 202 shown in FIG. 1, a middle plate 204 shown in FIG. 2, a lower plate 206 shown in FIG. 5, a right lateral plate 208 shown in FIG. 3, and left lateral plate 210 shown in FIG. 4. Upper plate 202 covers the lower portion of the wearer's thigh, middle plate 204 covers the wearer's patella, and lower plate 206 covers a substantial portion of the wearer's lower leg.

The shield is directly or indirectly coupled to or mounted on the cushioned pad. In the illustrated embodiment, thigh plate 202 is mounted on upper pad portion 106; patella plate 204 is mounted on middle pad portion 108; and lower leg plate is mounted on lower pad portion 110. The knee and surrounding area is protected by these plates. For example, the patella plate substantially covers and protects the wearer's patella, and each of the lateral plates substantially covers and protects each side of the wearer's knee joint. Depending on whether the knee guard is adapted for use with the left or right knee, the lateral plates would protect the lateral and medial sides of the knee joint when worn. For example, in a protective guard adapted for use with the right knee of the wearer, right lateral plate would protect the lateral side of the wearer's right knee, while left lateral plate would protect the medial side of the wearer's right knee.

As described herein, left lateral plate 208 also functions as a left knee clasp, and right lateral plate also functions as a right knee clasp. When these knee clasps are coupled to the patella plate, the lateral plates or knee clasps are indirectly operably coupled to the cushioned pad via the patella plate and form a middle protective portion of the shield. For example, in a knee guard adapted for the right knee of a human body, the patella plate would protect the patella, the right knee clasp would protect the lateral side of the knee, and the left knee clasp would protect the medial side of the knee.

In an alternative (non-illustrated) embodiment sized for protecting an elbow, the left lateral plate would function as a left elbow clasp, the right lateral plate would function as a right elbow clasp, and both clasps could operably couple to part of the shield, such as an elbow plate, to form a protective portion of the shield.

Figure 7:
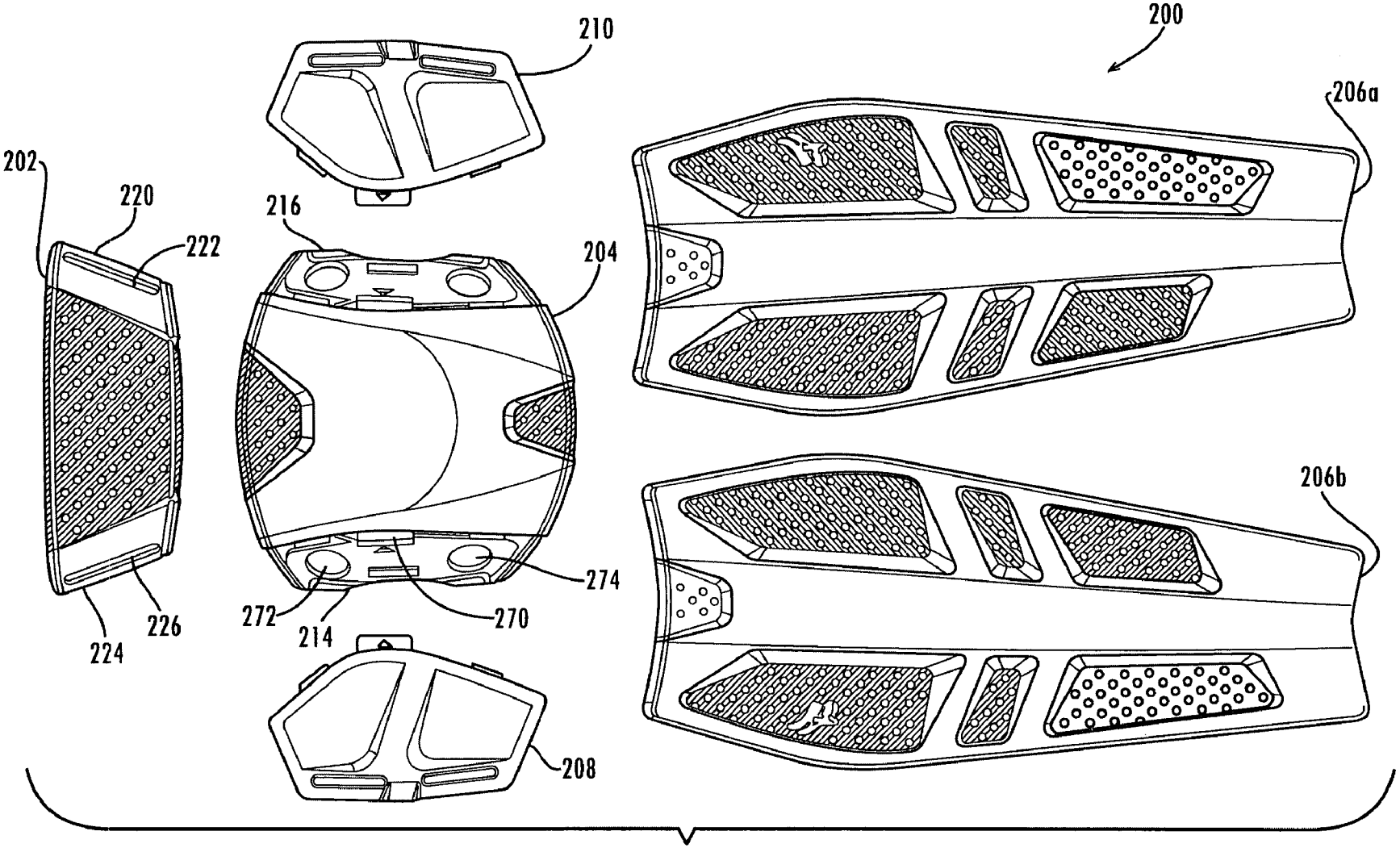
FIG. 7 shows an exploded arrangement and alignment of the plate and clasp components for use in protective gear according to the present invention.

In FIG. 7, two different embodiments of lower plate 206 are shown, one lower plate 206*a* sized to fit and protect the wearer's lower left leg and the second lower plate 206*b* sized to fit and protect the wearer's lower right leg. The lateral plates 208, 210 protect the lateral portions of the wearer's knee and together with patella plate 204 form a knee plate that substantially surrounds the ventral side of the knee joint when the protective guard 10 is worn.

Figure 10:
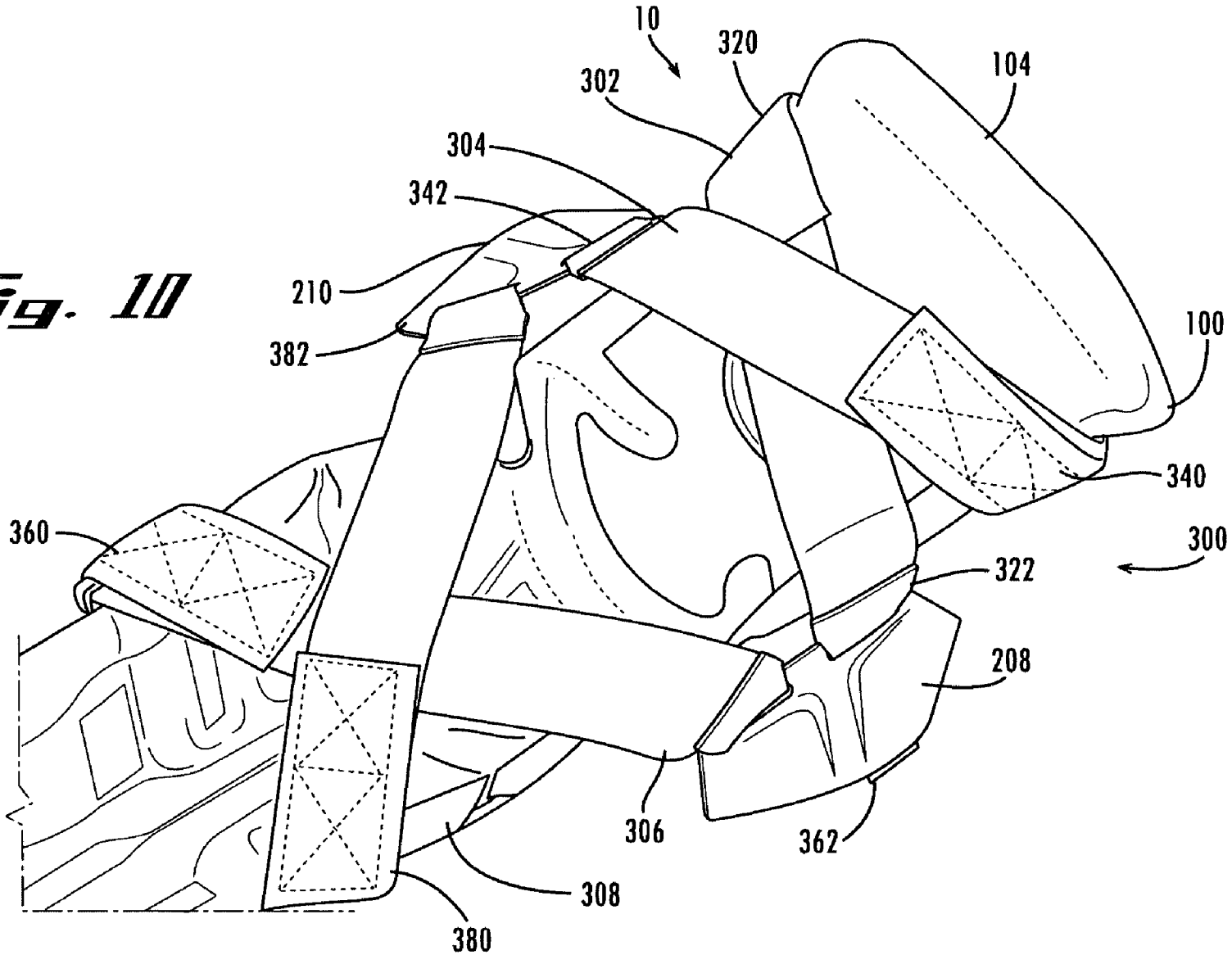
FIG. 10 shows a rear view of the upper part of the protective gear according to the present invention.
Figure 11:
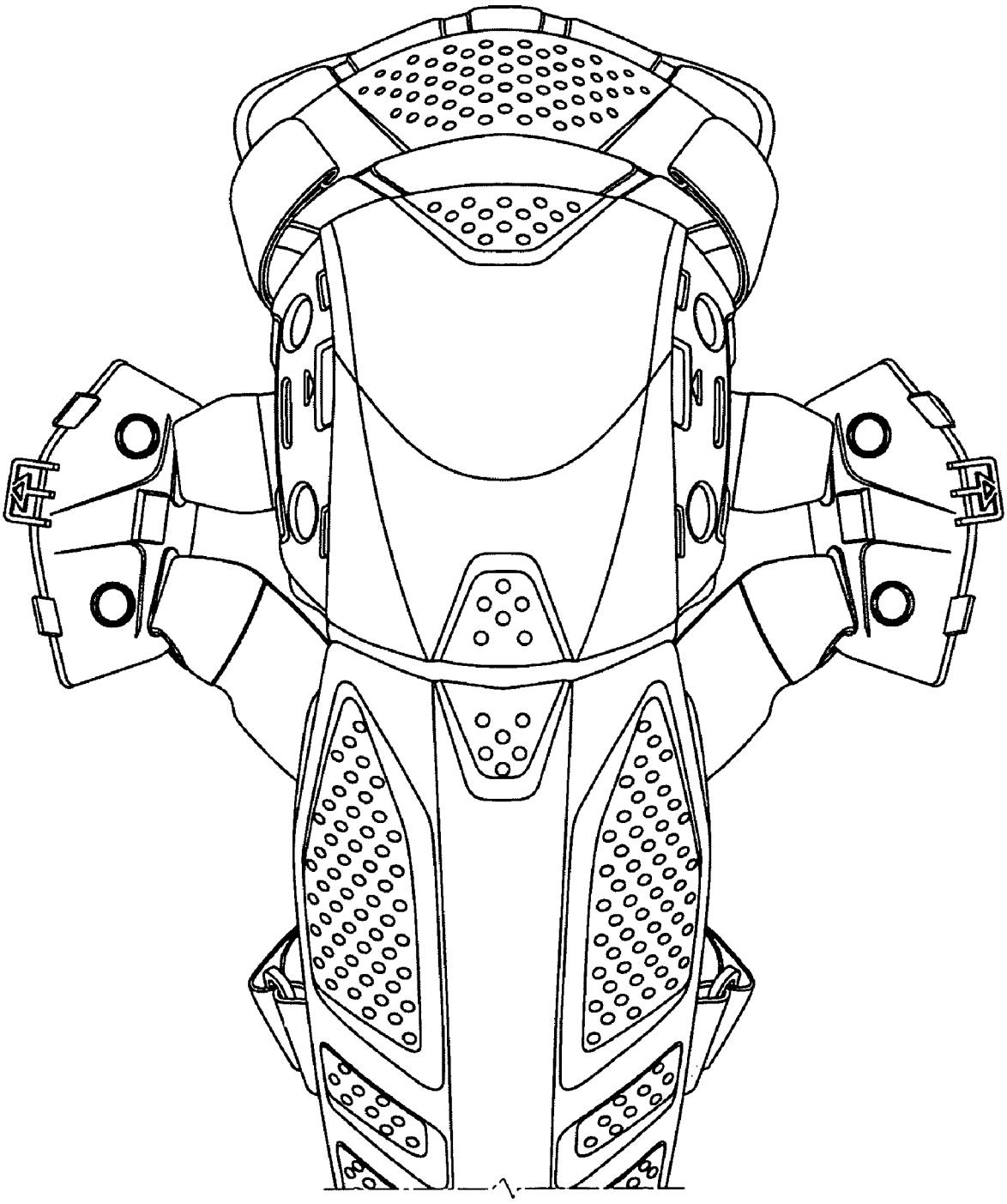
FIG. 11 shows a frontal view of the upper part of the protective gear according to the present invention, similar to FIG. 9, except that the clasps are shown apart and unattached from the patella plate.
Figure 12:
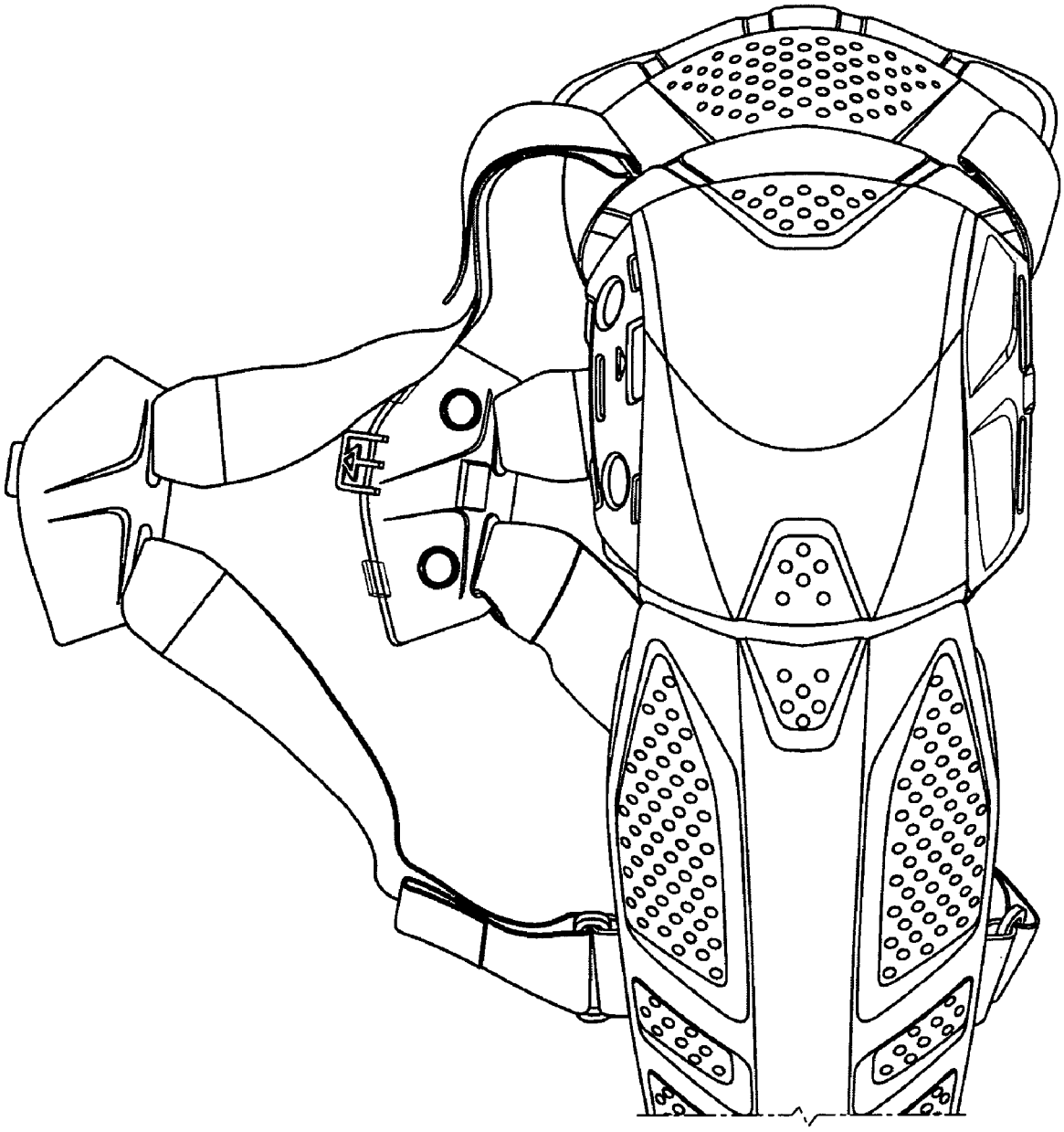
FIG. 12 shows a frontal view of the upper part of the protective gear according to the present invention, similar to FIGS. 9 and 11.
Figure 13:
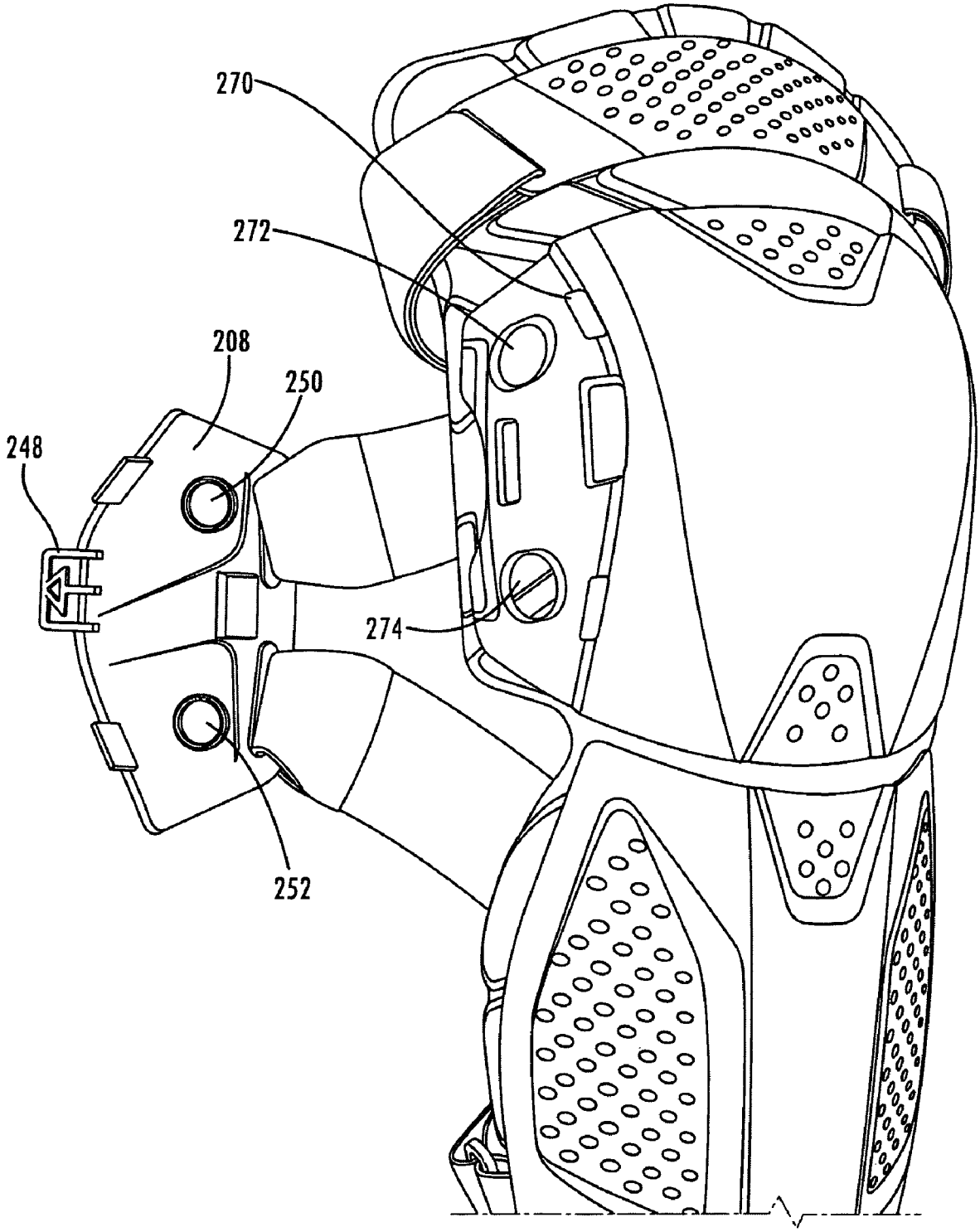
FIG. 13 shows a close-up frontal view of the upper part of the protective gear according to the present invention, similar to FIG. 9, except that the right clasp is shown apart and unattached from the patella plate.

The protective guard 10 is attached to the wearer's body using a novel attachment system 300, illustrated in FIGS. 10 and 18, which also can be considered attachment means or means for attachment. In the illustrated knee guard 10, the attachment system is composed of first and second upper straps 302, 304; and first and second lower straps 306, 308. These upper 302, 304 and lower straps 306, 308 operably connect different portions of knee guard 10 to the knee plate clasps 208, 210. The clasps then engage with and couple to the patella plate to secure the entire knee guard on the wearer's body.

The straps can be made from any suitable material, such as elastic or leather. The length or tension in the straps is adjustable, such as by using buckles or a hook-and-loop closure system like Velcro®, in order to allow the wearer to adjust the tightness and position of the knee guard when worn. The ends of straps are operably coupled to different parts of the knee guard, such as by snaps, hook-and-loop closures, or being strung through apertures.

In the illustrated embodiment, a first end 320 of first upper strap 302 is operably connected to first (left) side 220 of thigh plate 202 by threading through aperature 222. The second end 322 of first upper strap 302 is operably connected to upper end 240 of right knee plate clasp 208 by threading through aperture 242. The first end 340 of second upper strap 304 is operably connected to second (right) side 224 of thigh plate 202 by threading through aperature 226, and second end 342 of second upper strap 304 is operably connected to upper end 280 of left knee plate clasp 210 by threading through aperture 282.

The knee plate clasps 208, 210 are operably coupled to lower leg plate 206 in a similar manner. A first end 360 of first lower strap 306 is operably connected to first (left) side 230 of lower leg plate 206 by a fixed mount (not shown), such as being glued into place or affixed with a mounting pin, rivet, or grommet. The second end 362 of first lower strap 306 is operably connected to lower end 244 of right knee plate clasp 208 by threading through aperture 246. The first end 380 of second lower strap 308 is operably connected to second (right) side 232 of lower leg plate 206 by a fixed mount (not shown), and second end 382 of second lower strap 308 is operably connected to lower end 284 of left knee plate clasp 210 by threading through aperture 286. This arrangement of straps with the knee plate clasps unattached from the knee guard is shown in FIG. 18.

Knee guard 10 is worn by engaging knee plate clasps 208, 210 with patella plate 204 as described herein. When worn, upper 302, 304 and lower straps 306, 308 are wrapped behind the wearer's leg. The straps 302, 304, 306, 308 include an adjustment system or mechanism to allow the wearer to adjust the length and tension of the straps while the knee guard is worn. This adjustment system can be considered as adjustment means or means for adjustment. Suitable means for adjustment are described herein and in the patent literature, such as in U.S. Pat. No. 5,915,529 and in U.S. 2004/0083527. The adjustment system retains its adjustment settings until it is readjusted by the same or another wearer. The adjustment settings include (without limitation) the length and tension of the adjustable straps used in the attachment system; the positioning of the protective guard on the wearer's body when the attachment system is fully engaged; the threading, positioning, and orientation of a buckle along an adjustable straps; or the area of contact between the parts of a hook-and-loop attachment. Thus, a wearer can place the knee guard on his body a first time, adjust the means for adjustment to impute a suitable or preferred length or tensioning in the straps, and remove the knee guard. When the wearer puts on the knee guard a second time, no further adjustment in the attachment system should be necessary. The wearer can simply attach the knee guard quickly without further adjustment or readjustment, unless desired or if the wearer's physiology has changed in the intervening time since the first use, and some readjustment is required. Such an attachment system can be considered a one-time set-up attachment system for attaching and wearing the protective gear.

Knee plate clasps 208, 210 engage and are coupled to patella plate 204 via a coupling mechanism. This coupling mechanism also can be described as coupling means or means for coupling. The coupling mechanism of the right knee plate clasp 208 includes tabs 248*a*, 248*b*, and 248*c*; upper raised portion 250; lower raised portion 252; and clasp element 255.

Figure 14:
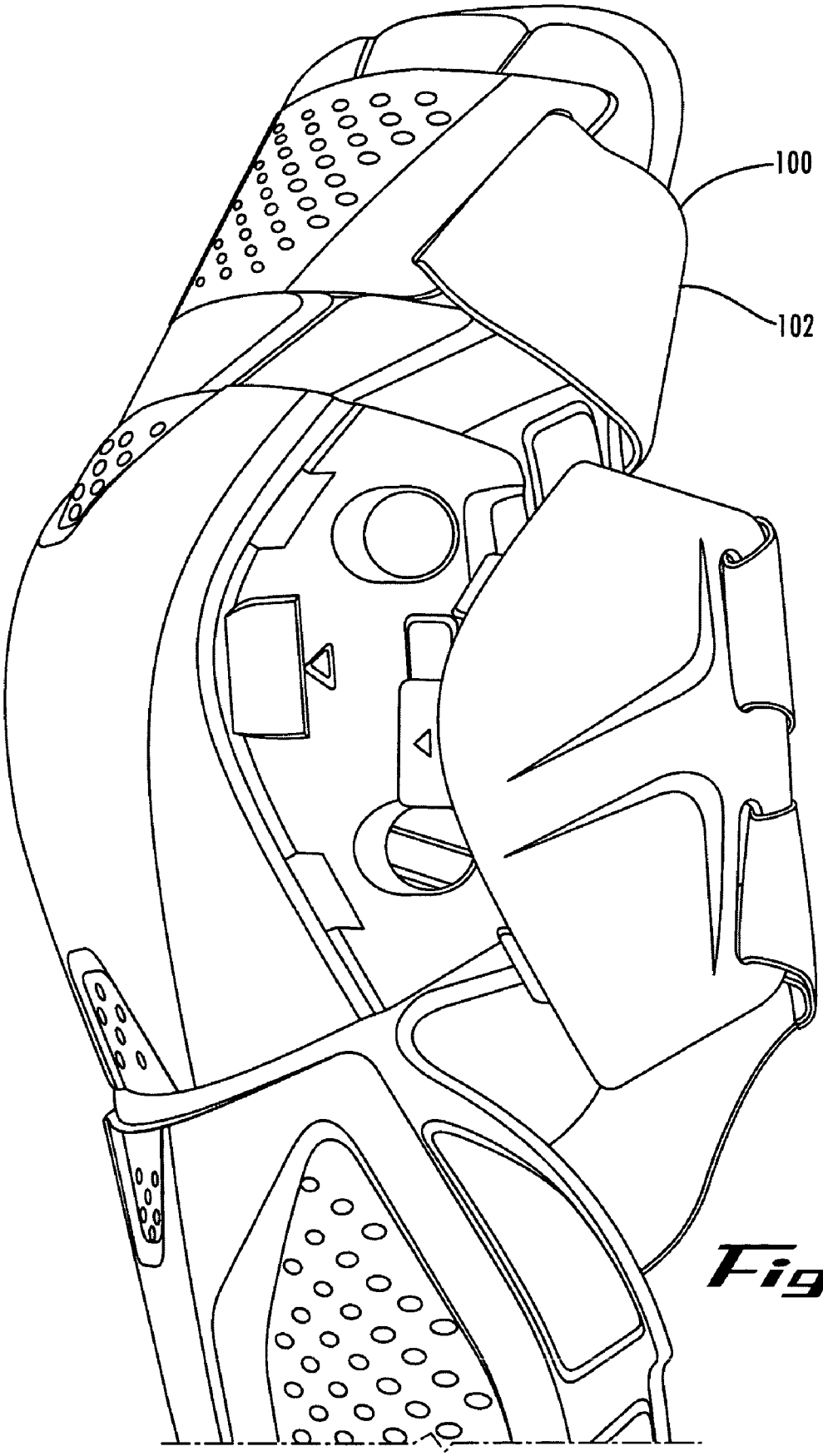
FIG. 14 shows a frontal view of the upper part of the protective gear according to the present invention, similar to FIGS. 9 and 11. The left clasp is shown proximate to the patella plate and in its position soon after removal from the patella late or just prior to attachment to the patella plate.
Figure 15:
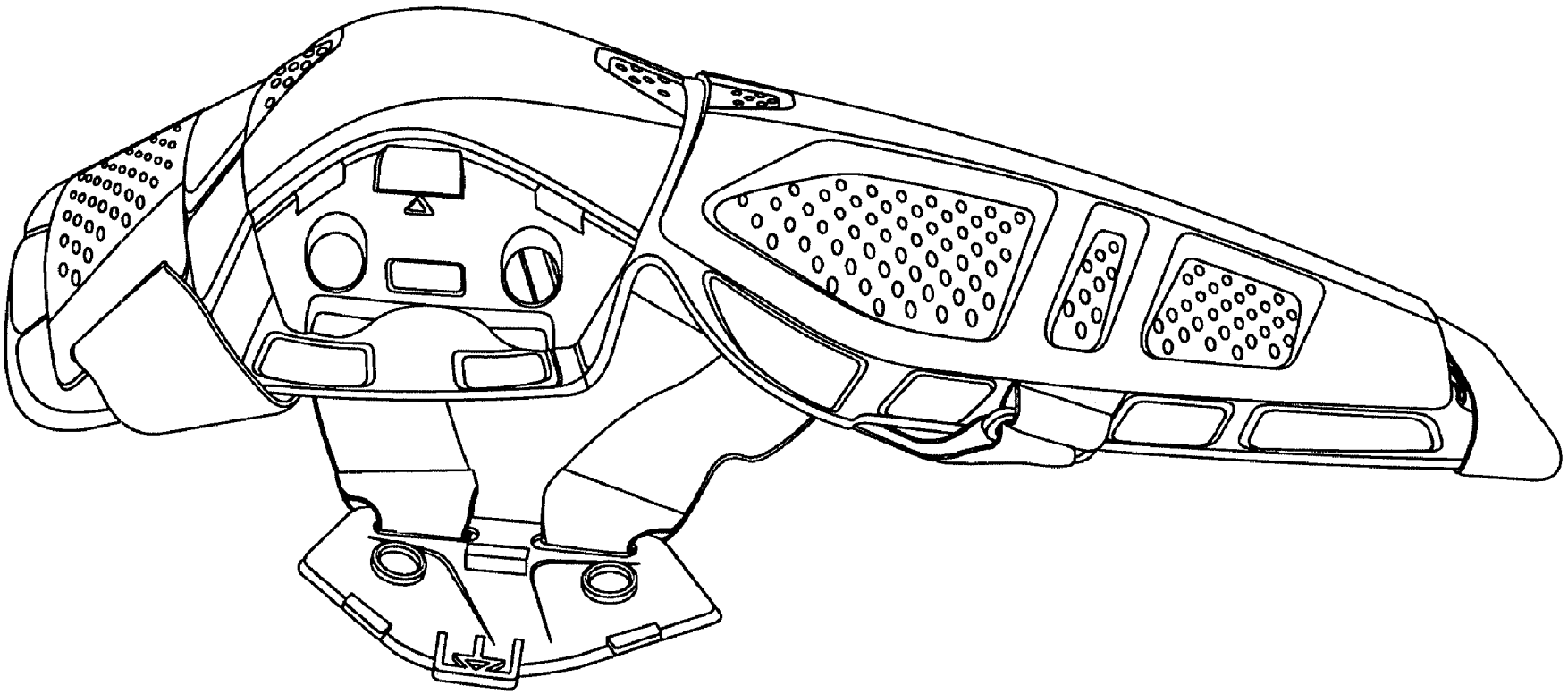
FIG. 15 shows a side view of the protective gear according to the present invention with the right clasp apart and unattached from the patella plate.
Figure 16:
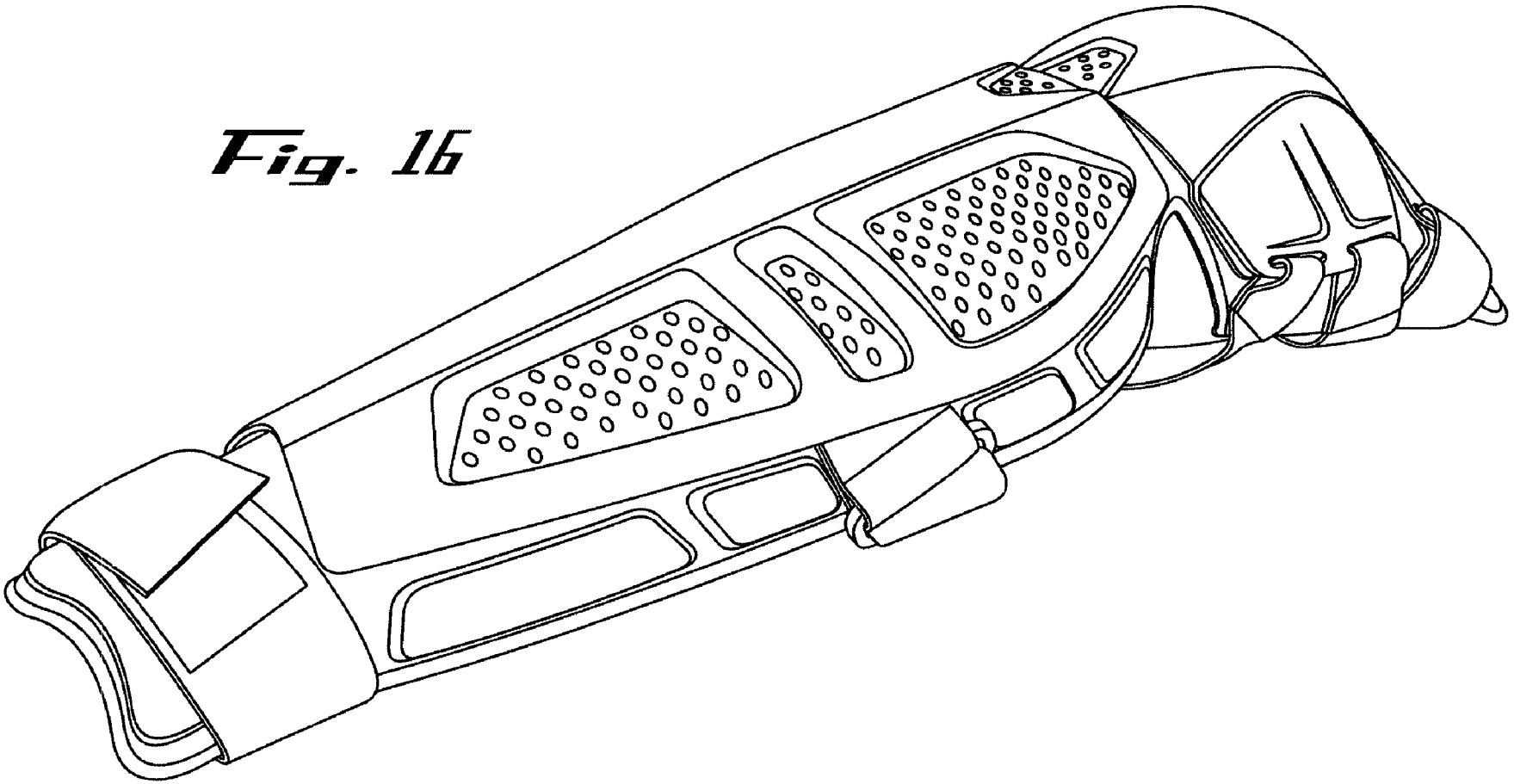
FIG. 16 shows a side view of the protective gear according to the present invention with the left clasp attached to the patella plate.
Figure 11:
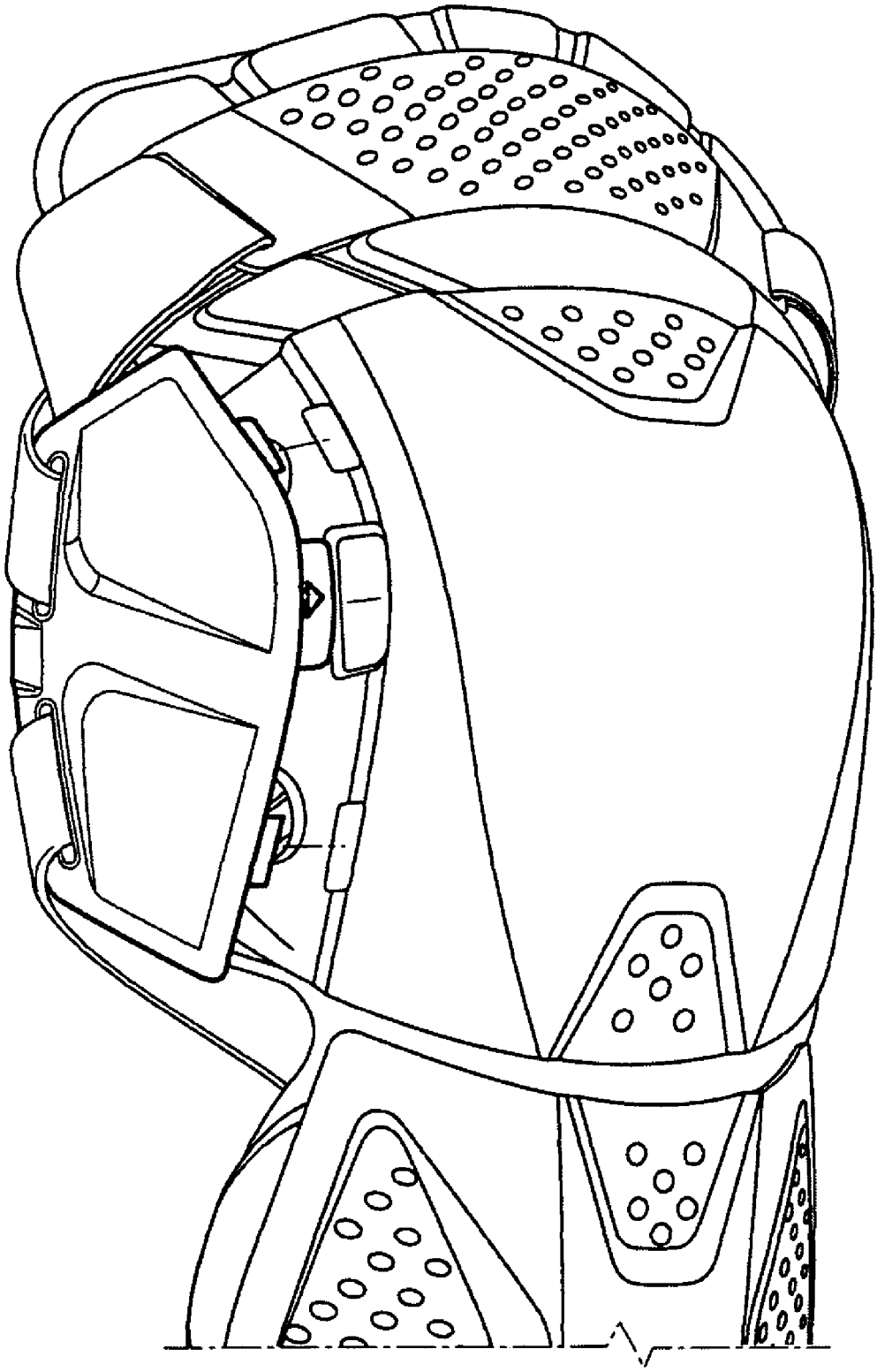
Figure 1B:
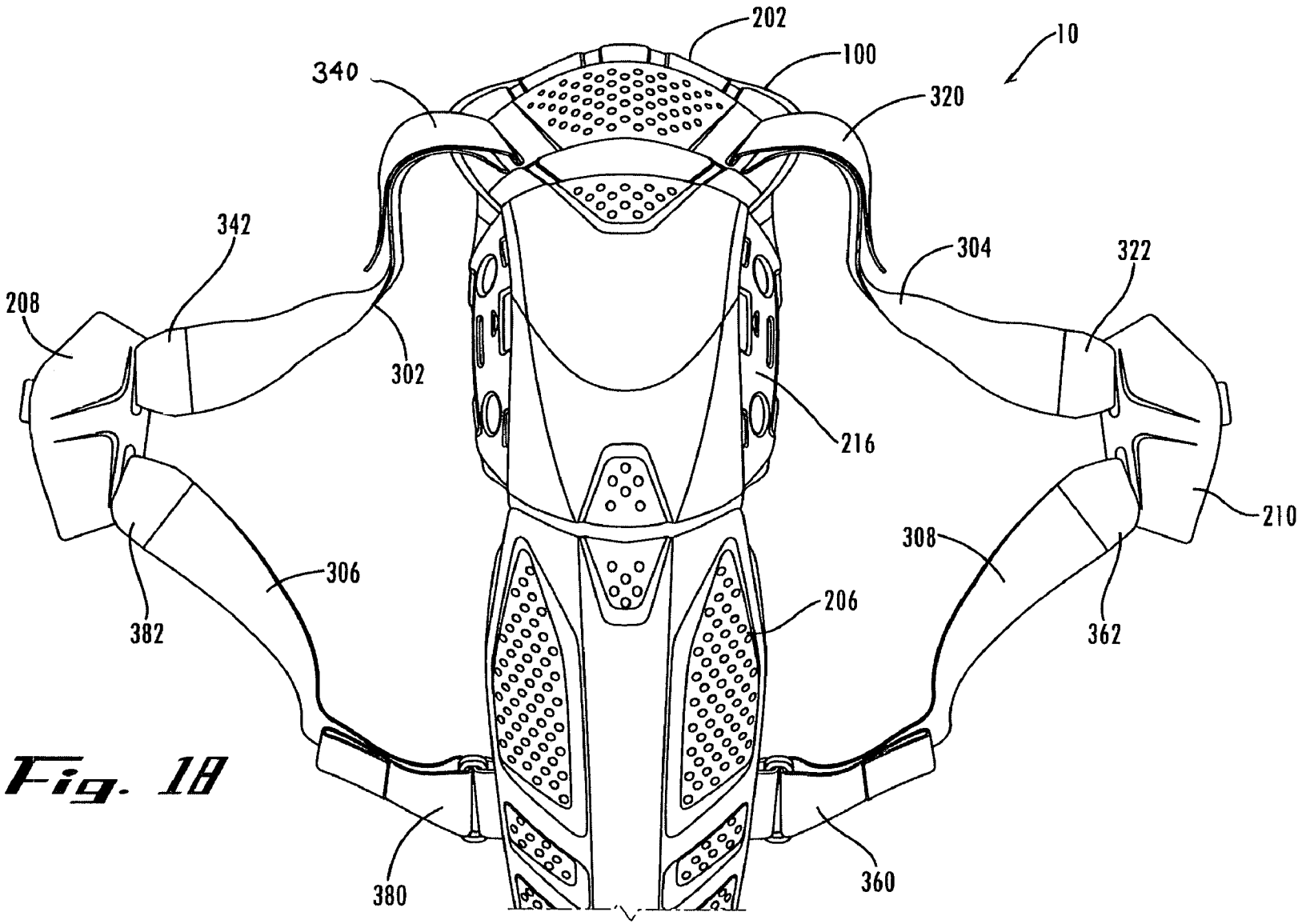

Coupling right knee plate clasp 208 to patella plate 204 is accomplished by sliding tab 248*a* into slot 270*a*, tab 248*b* into slot 270*b*, and tab 248*c* into slot 270*c*, all on right end 214 of patella plate 204; engaging upper raised portion 250 of right knee plate clasp 208 with right upper aperture 272 of patella plate 204; engaging lower raised portion 252 of right knee plate clasp 208 with right lower aperture 274 of patella plate 204; and engaging clasp element 255 with receiver 275. This engagement and coupling is illustrated in FIGS. 14 and 17. The clasp can then be fully engaged to and coupled with the patella plate by pushing clasp element 255 into the receiver 275 far enough for the receiver 275 to receive and retain clasp element 255 until the clasp is anchored into place, for example as shown in FIG. 8. Additionally, the raised portions (or nubs) 250, 252 slide into the apertures 270, 272 and provide resistance against torsional forces that might otherwise cause clasp element 255 to disengage from receiver 275 and right knee clasp 208 to disengage from patella plate 204.

The clasp element and corresponding or complementary receiver can be lockably engaged to ensure the knee clasp is firmly seated against the patella plate during use. The tabs and slots are complementary and help secure and/or stabilize the coupling of the knee clasp to the patella plate; they may be capable of locking or non-locking engagement that provides some stability in the seating and alignment of the knee clasp against the patella plate during use.

The illustrated embodiment includes three tabs 248*a*, 248*b*, and 248*c* and three corresponding or complementary apertures 270*a*, 270*b*, and 270*c* that receive the tabs. The three tabs are spaced along the edge of the knee clasp and offer more stability while the clasp is engaged with the patella plate, compared to embodiments having fewer tabs. Alternative embodiments can include a different number of tabs and corresponding apertures, such as a single tab, two tabs, or four or more tabs and a corresponding number of apertures. The tabs and apertures can be dimensioned to any appropriate or desired length, width, and thickness. For example (and without limitation), the right knee clasp/disengagable portion can include a single tab extending from a major portion of its edge, rather than the three illustrated tabs, or a series of four or more individual tabs spaced along its edge. In most embodiments, the number, position and dimensions of the slots 270*a-c* will correspond to the number, position and dimensions of the tabs 248*a-c*, because the slots receive the tabs. In some embodiments, the patella plate includes corresponding wells recessed into the patella plate, rather than apertures completely through the patella plate. Any equivalent structure can be utilized that allows projections from the knee clasp (such as the illustrated tabs) to be received and retained by corresponding recesses or apertures in the patella plate.

The illustrated raised portions or nubs 250, 252 and apertures 272,274 are circular in cross-section. However, alternative embodiments include nubs that are square, rectangular, triangular, oval, hexagonal, or other shape in cross-section with apertures of corresponding or complementary shape. The nubs and apertures can be dimensioned as desired as long as the engagement of the nubs with the apertures provides at least some resistance to torsional forces applied to the knee clasp/disengagable portion. In alternative embodiments, the nubs are received in wells or recesses within the material of the patella plate, rather than apertures completely through the patella plate. Any equivalent structure can be utilized that allows raised portions on the knee clasp (such as the illustrated nubs) to be received and retained by corresponding recesses or apertures in the patella plate.

In the illustrated embodiment, clasp element 255 is a linear element extending from a face of knee clasp 208 and located adjacent the center of knee clasp 208, while receiver 275 is an aperture in a corresponding location adjacent the center of the docking portion of patella plate 204. In alternative embodiments, the clasp element and corresponding receiver are of a different size and shape than what is illustrated. Additionally, the clasp element and aperture can be placed in different corresponding positions on the knee clasp and patella plate, and more than one clasp element and corresponding aperture can be used. Nor is it necessary for the receiver to be an aperture through the patella plate. For example, clasp element could have a peg-like shape that can be anchored into a well-shaped receiver (that is not an aperture through the patella plate). Any equivalent structure can be utilized that allows the clasp element from the knee clasp to be received by and anchored into the corresponding receiver on the patella plate.

The left knee clasp can be engaged with or coupled to the patella plate in a similar manner as that described for the right knee clasp. In FIG. 17, the right knee clasp is shown disengaged from the patella plate, while the left knee clasp is shown engaged, coupled to, and firmly seated with the patella plate. This coupling mechanism offers a stronger and more secure attachment than previously known coupling mechanisms, such as buckles.

The knee clasps 208, 210 also can be considered disengagable portions of the protective shield that can be operably coupled to docking portions of the shield. In the illustrated embodiment, a first docking portion is located adjacent the right end 214 of patella plate 204 and a second docking portion is located adjacent left end 216 of patella plate 204.

Figure 2:
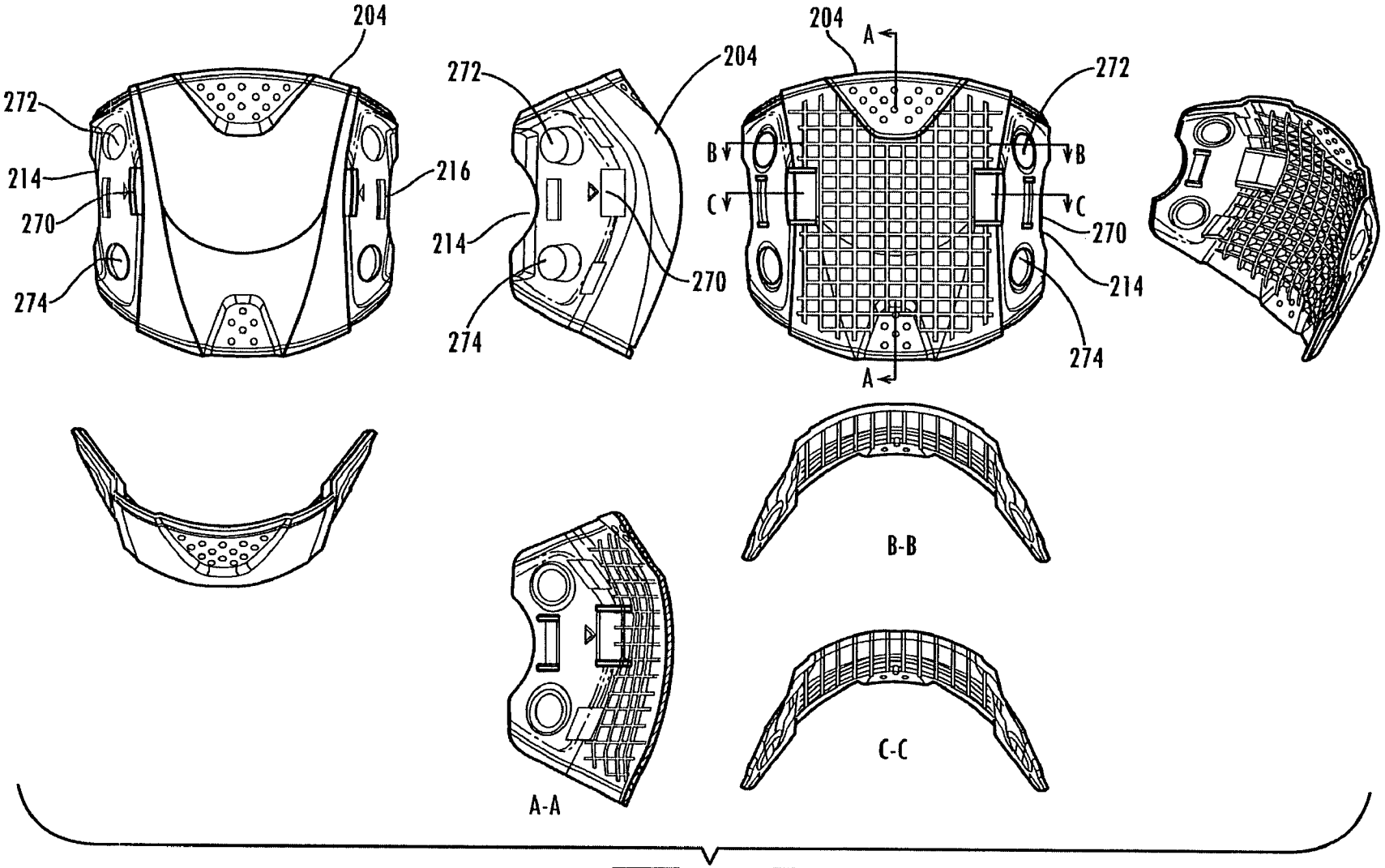
FIG. 2 shows several different views of a patella plate for use in protective gear according to the present invention.
Figure 3:
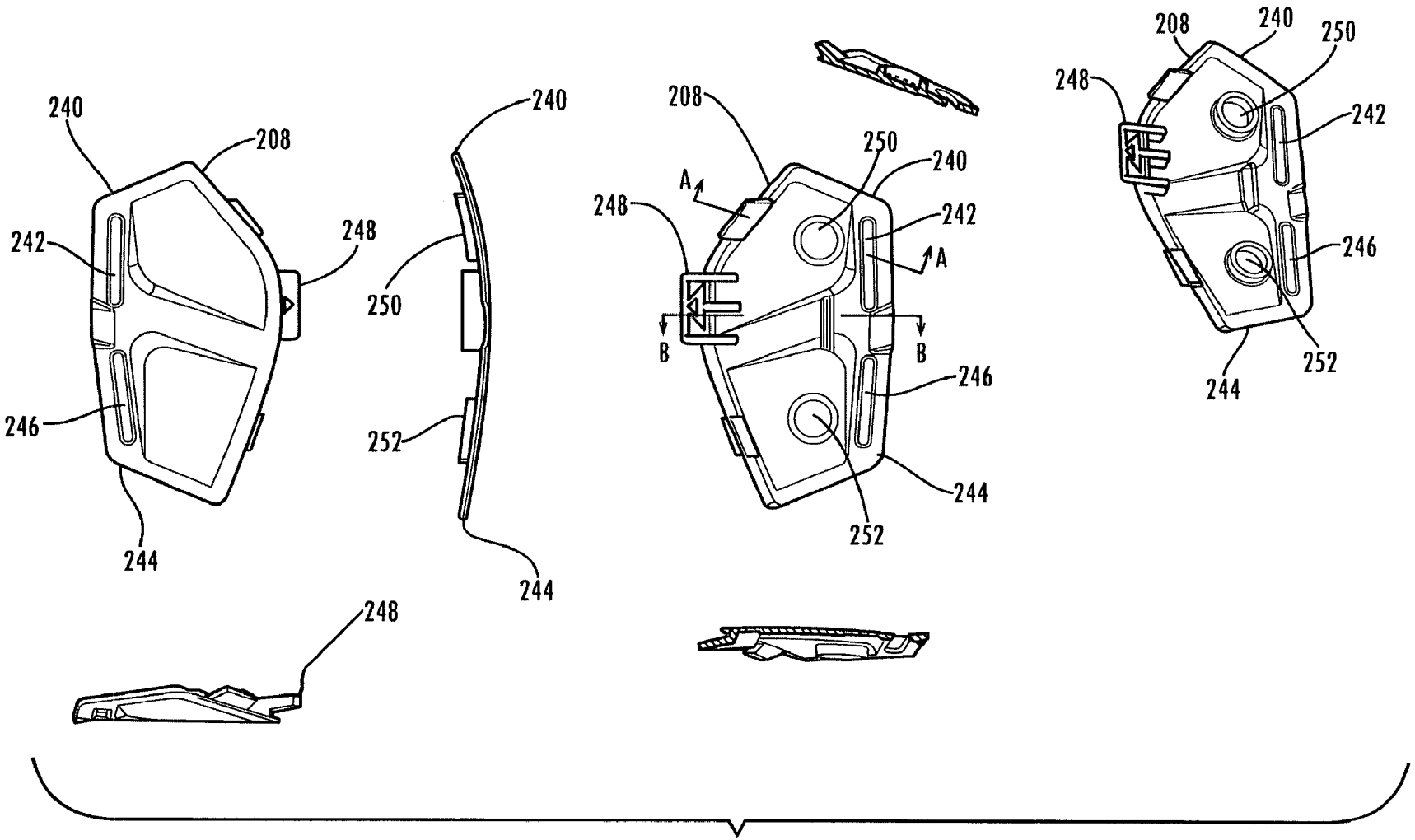
FIG. 3 shows several different views of a first knee plate clasp for use in protective gear according to the present invention.
Figure 4:
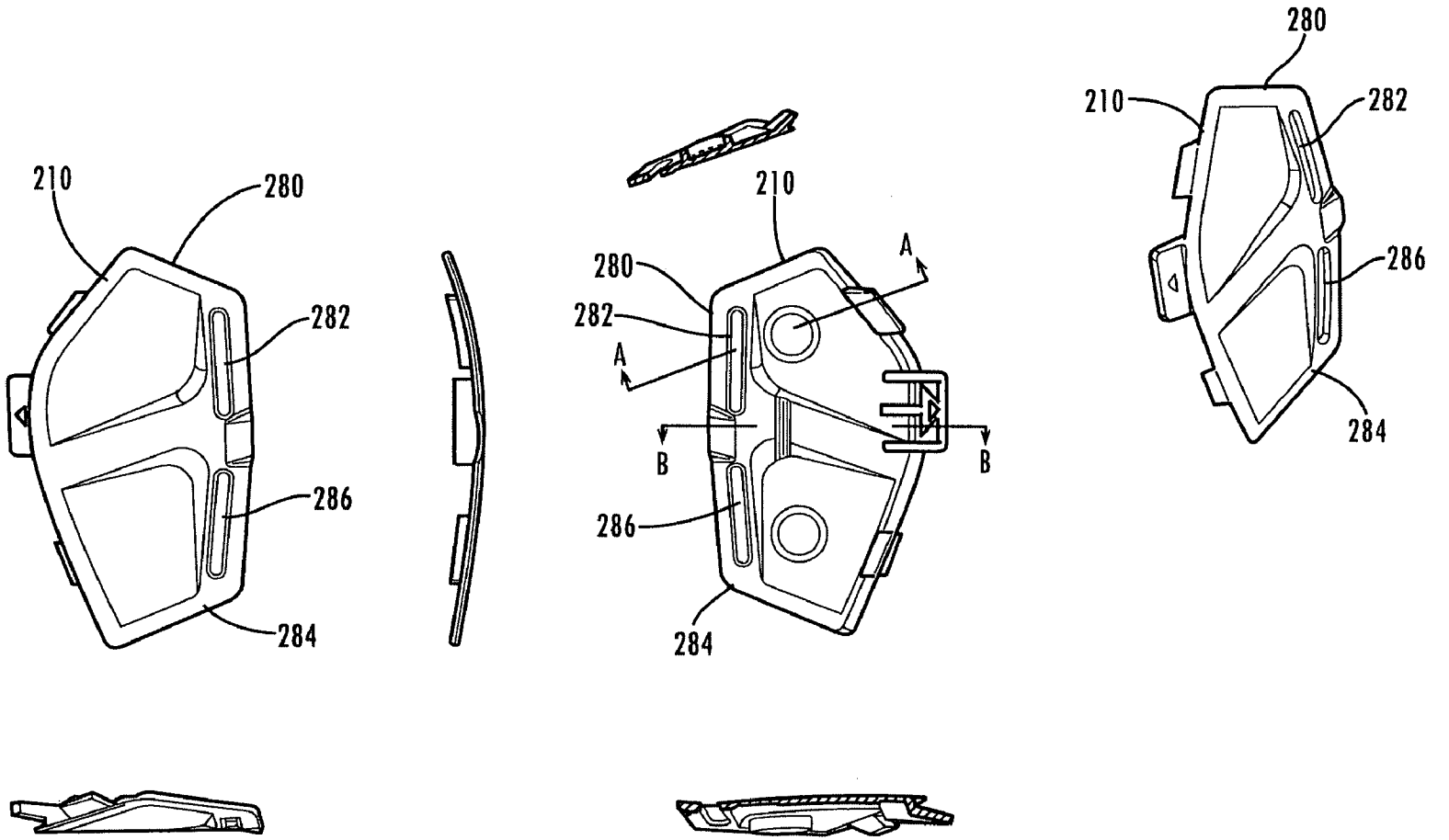
FIG. 4 shows several different views of a second knee plate clasp for use in protective gear according to the present invention.
Figure 5:
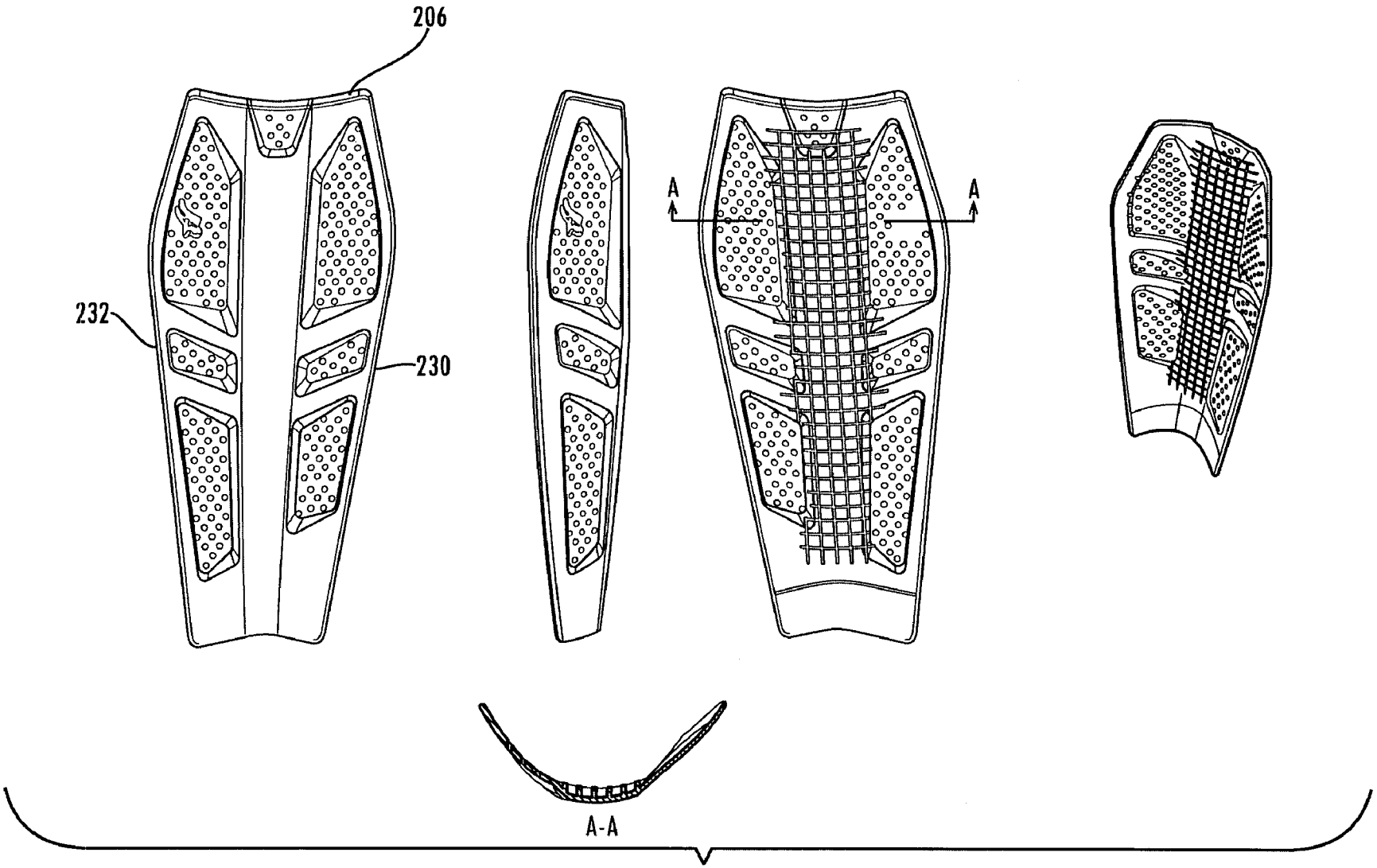
FIG. 5 shows several different views of a lower leg plate for use in protective gear according to the present invention.
Figure 6:
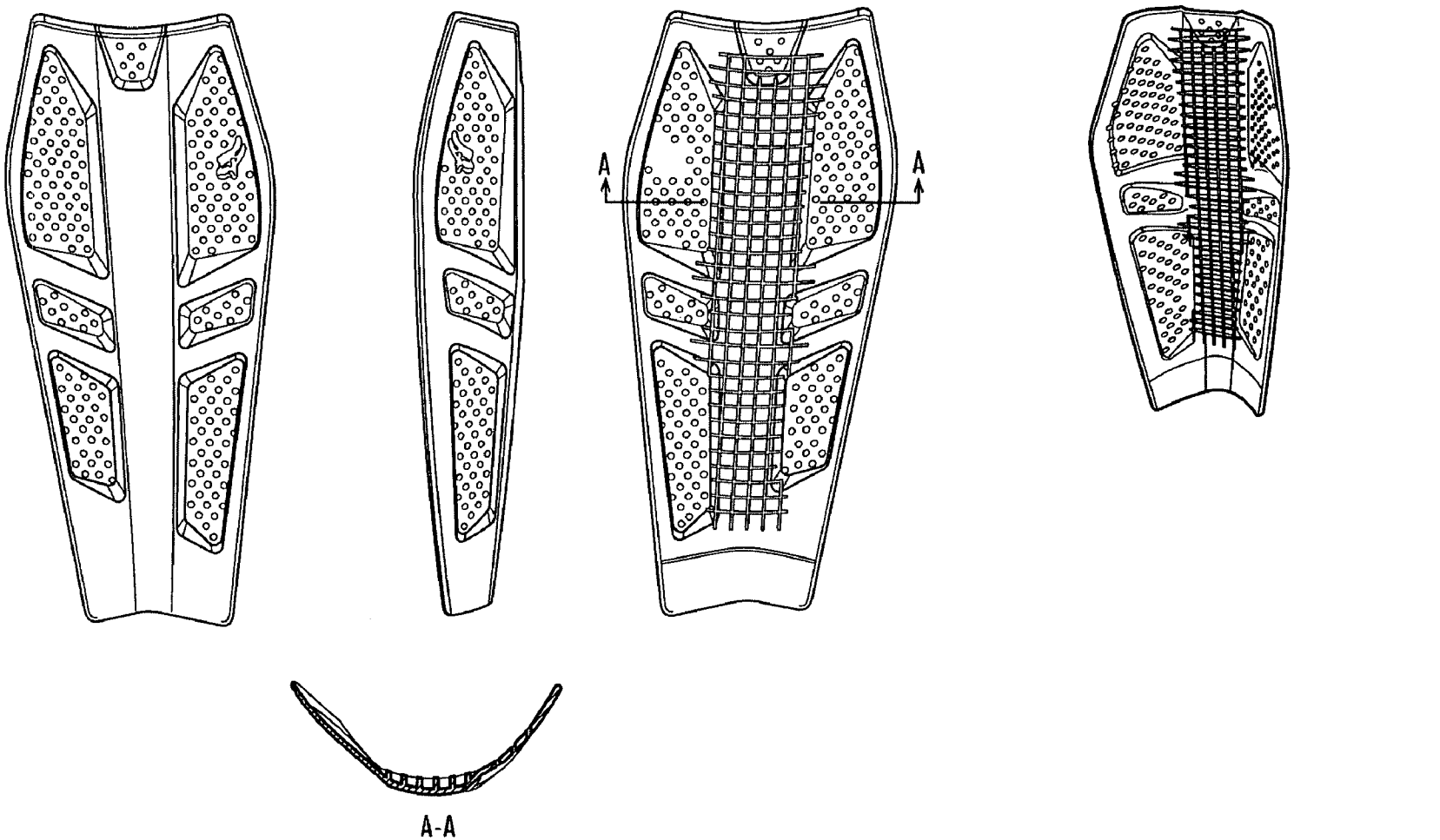
FIG. 6 shows several different views of an alternative embodiment of the lower leg plate for use in protective gear according to the present invention.

Each disengagable portion includes a coupling element that engages with and couples to a coupling element located on the docking portion. Referring to FIGS. 2 and 3, the first coupling element includes clasp element 255; nubs 250, 252; and tabs 248*a-c*; while the second coupling element includes corresponding receiver 275; apertures 272, 274; and slots 270*a-c*. The third coupling element would include the corresponding clasp element, nubs and tabs on the left knee clasp 210, which also can be described as a second disengagable portion. This third coupling element would engage with and couple to a fourth coupling element on the second docking portion, which includes the corresponding receiver, apertures and slots.

The patella plate 204 is the middle protective portion of the shield, but that middle protective portion also can include the knee clasps 208, 210. In alternative embodiments, the middle protective portion of the shield includes only a single knee clasp/disengagable portion.

An additional advantage of these knee clasps is the increased protection offered to the wearer compared to previously known attachment mechanisms, such as the rings and straps illustrated in U.S. Pat. No. 5,915,529 (herein incorporated by reference) or the buckles and straps used in the Raptor™ protective guards, (a prior system of the assignee). While these previously known protective guards offer good protection to the wearer, the clasps of the present invention offer improved protection and additional benefits to the wearer. For example, as shown in FIGS. 2-4, 9 and 13-14, right knee clasp 208 functions as part of shield 200 when it is fully engaged with patella plate 204. The clasp/lateral plate not only provides additional protection to the wearer by covering the right lateral part of the wearer's knee, but also protects the attachment points as well. Previously known protective guards utilized buckles exposed to the open environment and at risk of impact during a collision with the ground or some object. In the present invention, the attachment points are covered by part of the protective shield. When knee clasp/disengagable portion 208 is fully coupled to patella plate 204 to form the middle protective portion of the shield, the outer surface of disengagable portion 208 is substantially flush with the outer surface of patella plate 204. Additionally, the coupling elements of disengagable portion 208 and the corresponding docking portion of patella plate 204 are hidden from external view. Thus, the shield protects the coupling mechanism from external forces, such as abrasion or impact, that could otherwise damage the coupling mechanism or cause it to disengage, break apart, or come loose during use.

In some embodiments, the coupling means are constructed in such a way that an signal is produced when the left or right knee clasp is coupled with the patella plate. For example, in the illustrated embodiment, an audible popping sound is produced when clasp element 255 is pushed into receiver 275 and knee clasp 208 snaps into place flush against patella plate 204. This signal indicates to the wearer that the protective gear is securely attached to his or her body and fully ready for use. The signal can be any type of recognizable signal, such as a visual, auditory, or tactile signal, or a combination thereof.

The articles "a" and "an" are not intended to limit the number of objects to which they refer, unless the context clearly indicates otherwise. For example, the term "an adjustable strap" is intended to mean "a single adjustable strap," "at least one adjustable strap," or "more than one adjustable strap." The term "or" is not intended to limit the number of alternatives implied by its use as a conjunction. For example, the term "an auditory or tactile signal" can mean "an auditory signal," "a tactile signal," or "both an auditory signal and a tactile signal." The present specification is intended to control in cases of conflict with terms or concepts described elsewhere. Any materials, methods, or examples presented in this specification are illustrative only and not limiting.

Representative embodiments of the present invention are shown in FIGS. 1-18, wherein similar features share common reference numerals; unless clearly stated otherwise, the drawings are not to scale. Persons skilled in the art will recognize that many modifications and variations are possible in the details, materials, and arrangements of the parts and actions which have been described and illustrated in order to explain the nature of this invention and that such modifications and variations do not depart from the spirit and scope of the teachings and claims contained therein.

We claim:

1. A protective guard for a predetermined body part, comprising:

a protective shield comprising a disengagable shield portion and a docking shield portion that combine to form an integral protective shield for the predetermined body part, wherein the disengagable shield portion is capable of attaching to the docking shield portion along a lateral side of the docking shield portion, and wherein the disengagable shield portion includes a first coupling element and the docking shield portion includes a second complementary coupling element;

an attachment system operably connected to the disengagable shield portion and operably connected to the docking shield portion so that attaching the disengagable shield portion to the docking shield portion enables the shield to be secured to the body part;

wherein the complementary coupling elements have attachment points that when engaged are at least partially covered by at least one of the shield portions;

wherein the shield is generally shaped to correspond to the anatomical shape of the knee; and wherein the disengagable portion is generally shaped to correspond to the anatomical shape of the lateral side of the knee.

2. The protective guard of claim 1 wherein the shield further comprises a second disengagable portion and a second docking portion;

wherein the second disengagable portion is capable of coupling to the second docking portion;

wherein the attachment system is operably coupled to the second disengagable portion and operably connected to the second docking portion;

wherein attaching the protective guard to the body comprises coupling the second disengagable portion to the second docking portion.

3. The protective guard of claim 2 wherein the first disengagable portion is generally shaped to correspond to the anatomical shape of a lateral side of the knee and the second disengagable portion is generally shaped to correspond to the anatomical shape of a medial side of the knee.

4. The protective guard of claim 1 wherein the protective shield includes an inner surface and an outer surface, and wherein the first coupling element extends inward from the inner surface of the disengagable portion of the shield.

5. The protective guard of claim 4 wherein the outer surface of the disengagable portion is substantially flush with the outer surface of the docking portion when the disengagable portion is coupled to the docking portion.

6. The protective guard of claim 1 wherein the disengagable portion and the docking portion comprise a middle protective portion of the shield, the shield further comprising an upper protective portion moveably coupled to the middle protective portion and a lower protective portion moveably coupled to the middle protective portion.

7. A protective guard for a predetermined body part, comprising:

a protective shield comprising a disengagable shield portion and a docking shield portion that combine to form an integral protective shield for the predetermined body part, wherein the disengagable shield portion is capable of attaching to the docking shield portion along a lateral side of the docking shield portion, and wherein the disengagable shield portion includes a first coupling element and the docking shield portion includes a second complementary coupling element;

an attachment system operably connected to the disengagable shield portion and operably connected to the docking shield portion so that attaching the disengagable shield portion to the docking shield portion enables the shield to be secured to the body part;

wherein the complementary coupling elements have attachment points that when engaged are at least partially covered by at least one of the shield portions;

wherein the disengagable portion and the docking portion comprise a middle protective portion of the shield, the shield further comprising an upper protective portion moveably coupled to the middle protective portion and a lower protective portion moveably coupled to the middle protective portion; and wherein the shield is generally shaped to correspond to the anatomical shape of a knee of a human body, the middle protective portion is generally shaped to correspond to the anatomical shape of the patella and lateral sides of the knee, the upper protective portion has a general shape that protects the upper part of the knee and lower thigh, and the lower protective portion has a general shape that protects the lower part of the knee and lower leg.

8. The protective guard of claim 1 wherein coupling the disengagable portion to the docking portion emits a signal indicating that the guard is adequately attached to the wearer.

9. The protective guard of claim 8 wherein the signal is an auditory or tactile signal.

10. The protective guard of claim 1 wherein the disengagable portion includes a clasp element and wherein the docking portion includes a corresponding retainer that receives and retains the clasp element.

11. The protective guard of claim 1 wherein the attachment system is a one-time set-up attachment system.

12. The protective guard of claim 1 wherein the first coupling element comprises at least one tab, and the second coupling element comprises at least one complementary slot, and the tab slideably or lockably engages the slot when the disengagable portion is coupled to the docking portion, the tab and slot providing some stability in the alignment of the first disengagable portion and first docking portion.

13. The protective guard of claim 1 wherein the coupling elements have attachment points that align the surfaces of the protective shield portions in a both overlapping and abutting relationship.

14. The protective guard of claim 1 wherein at least one coupling element is formed in the protective shield material.

15. The protective guard of claim 1 wherein there is at least one pair of first and second coupling elements comprising a tab and a complementary slot.

16. The protective guard of claim 1 wherein there is at least one pair of first and second coupling elements comprising a nub and a complementary recess or aperture.

17. The protective guard of claim 1 wherein the protective shield comprises any suitable material that resists abrasion, impact, puncturing, shattering, torsion, and similar forces anticipated during use, including plastic or other polymer; metal.

18. The protective guard of claim 17 wherein the protective shield comprises one of the following materials: tungsten, stainless steel, or other alloy; Kevlar, ballistic nylon, or other similar fabric or carbon fiber.

* * * * *